US008092159B2

(12) United States Patent
Maldonado

(10) Patent No.: US 8,092,159 B2
(45) Date of Patent: Jan. 10, 2012

(54) FEEDING FILM COOLING HOLES FROM SEAL SLOTS

(75) Inventor: Jaime Maldonado, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 514 days.

(21) Appl. No.: 12/415,372

(22) Filed: Mar. 31, 2009

(65) Prior Publication Data

US 2010/0247286 A1 Sep. 30, 2010

(51) Int. Cl.
*F01D 5/18* (2006.01)

(52) U.S. Cl. ..... 415/173.1; 415/180; 416/96 R; 29/889.721

(58) Field of Classification Search ..... 415/180; 416/96 R, 231 B; 29/889.721
See application file for complete search history.

(56) References Cited

U.S. PATENT DOCUMENTS

| | | | | |
|---|---|---|---|---|
| 5,062,768 | A | 11/1991 | Marriage | |
| 5,417,545 | A | 5/1995 | Harrogate | |
| 5,503,528 | A * | 4/1996 | Glezer et al. | 416/96 R |
| 6,210,111 | B1 | 4/2001 | Liang | |
| 6,254,333 | B1 | 7/2001 | Merry | |
| 6,340,285 | B1 | 1/2002 | Gonyou et al. | |
| 6,343,911 | B1 * | 2/2002 | Burdgick | 415/115 |
| 6,412,268 | B1 | 7/2002 | Cromer et al. | |
| 6,547,257 | B2 | 4/2003 | Cromer | |
| 7,097,417 | B2 | 8/2006 | Liang | |
| 7,137,777 | B2 * | 11/2006 | Fried et al. | 415/115 |
| 7,832,986 | B2 * | 11/2010 | Baker et al. | 416/96 R |
| 2007/0003407 | A1 * | 1/2007 | Turner et al. | 415/115 |
| 2008/0053107 | A1 * | 3/2008 | Weaver et al. | 60/800 |
| 2010/0183426 | A1 * | 7/2010 | Liang | 415/110 |

* cited by examiner

*Primary Examiner* — Stephen W Smoot

(74) *Attorney, Agent, or Firm* — Nixon & Vanderhye, P.C.

(57) ABSTRACT

A cooling arrangement for a first stage nozzle of a turbine includes a slot formed in a forward face of the first stage nozzle, the slot opening in a direction facing a combustor transition piece and adapted to receive a flange portion of a seal extending between the first stage nozzle and the transition piece. The slot has a closed end formed with at least one cooling cavity provided with at least one cooling passageway extending between the cavity and an external surface of the first stage nozzle.

20 Claims, 2 Drawing Sheets

FEEDING FILM COOLING HOLES FROM SEAL SLOTS

This invention relates to gas turbine component cooling techniques and, more specifically, to a manner of feeding cooling air to film cooling holes in turbine components with seal slots.

BACKGROUND OF THE INVENTION

Gas turbine engines operate at elevated temperatures, and film cooling is widely used to protect components from the harsh high-temperature environment. Maintaining metal temperatures for gas turbine components within material limits has been addressed by many different techniques such as film cooling, impingement cooling, low conductivity coatings and heat augmentation devices such as turbulators, ribs, pin fin banks, etc.

Film cooling is widely used in connection with gas turbine first-stage components and to a lower extent in subsequent stages. Standard practice among the industry is to feed these film cooling holes from existing cavities built into the component. This severely limits flexibility with respect to drilling holes at locations not aligned with the cavities. As a result, the designer oftentimes cannot place film cooling at locations of high level temperatures, or has to orient the cooling holes at angles that reduce the impact of the film cooling. Competitors have addressed this issue in the past by machining dedicated chambers and serpentine passages into the component. These features are only manufactured for the purpose of feeding these holes, and add extra manufacturing cost to the component.

Specific examples in the prior art include cooling holes fed from cavities cast into the turbine sidewalls as exemplified by U.S. Pat. No. 5,344,283. Other approaches for casting dedicated chambers into the sidewalls with the intent of feeding film cooling holes are disclosed in U.S. Pat. Nos. 6,254,333 and 6,210,111. A cavity formed by seal plates in a cold side of a stage one turbine nozzle is disclosed in U.S. Pat. No. 5,417,545. A concept for machining multiple cooling holes such that they feed from the same aperture in a cold side cavity is disclosed in U.S. Pat. No. 5,062,768. The assignee of this invention presents a concept for pressurizing a seal slot with air from cooling cavities for the purpose of cooling the seal itself in U.S. Pat. No. 6,340,285.

BRIEF DESCRIPTION OF THE INVENTION

In a first exemplary but non-limiting aspect, the present invention relates to a cooling arrangement for a turbine component having a slot along an edge thereof, the slot having a closed end formed with at least one cooling cavity, and at least one cooling passageway extending between the cavity and an external surface of the turbine component.

In another aspect, the invention relates to a cooling arrangement for a first component of a turbine having a seal slot formed in a forward face of the component, the seal slot extending about a generally rectangular opening in said forward face and opening in a direction toward a second turbine component and adapted to receive a flange portion of a seal extending between the first component and the second component; the slot having a closed aft end formed with at least one cooling cavity provided with at least one cooling passage extending between the cavity and an external surface of the first component, and wherein said at least one cooling passage extends at an acute angle relative to a rotor axis of the turbine.

In still another aspect, the invention relates to a method of film cooling a turbine component formed with at least one seal slot adapted to receive a seal element, the method comprising (a) forming one or more cavities at a closed end of the seal slot; (b) forming one or more cooling passages in each of the one or more cavities, the one or more cooling passages extending between the one or more cavities and a surface of the turbine component to be cooled.

The invention will now be described in detail in connection with the drawings identified below.

DETAILED DESCRIPTION OF THE DRAWINGS

Figure 1:
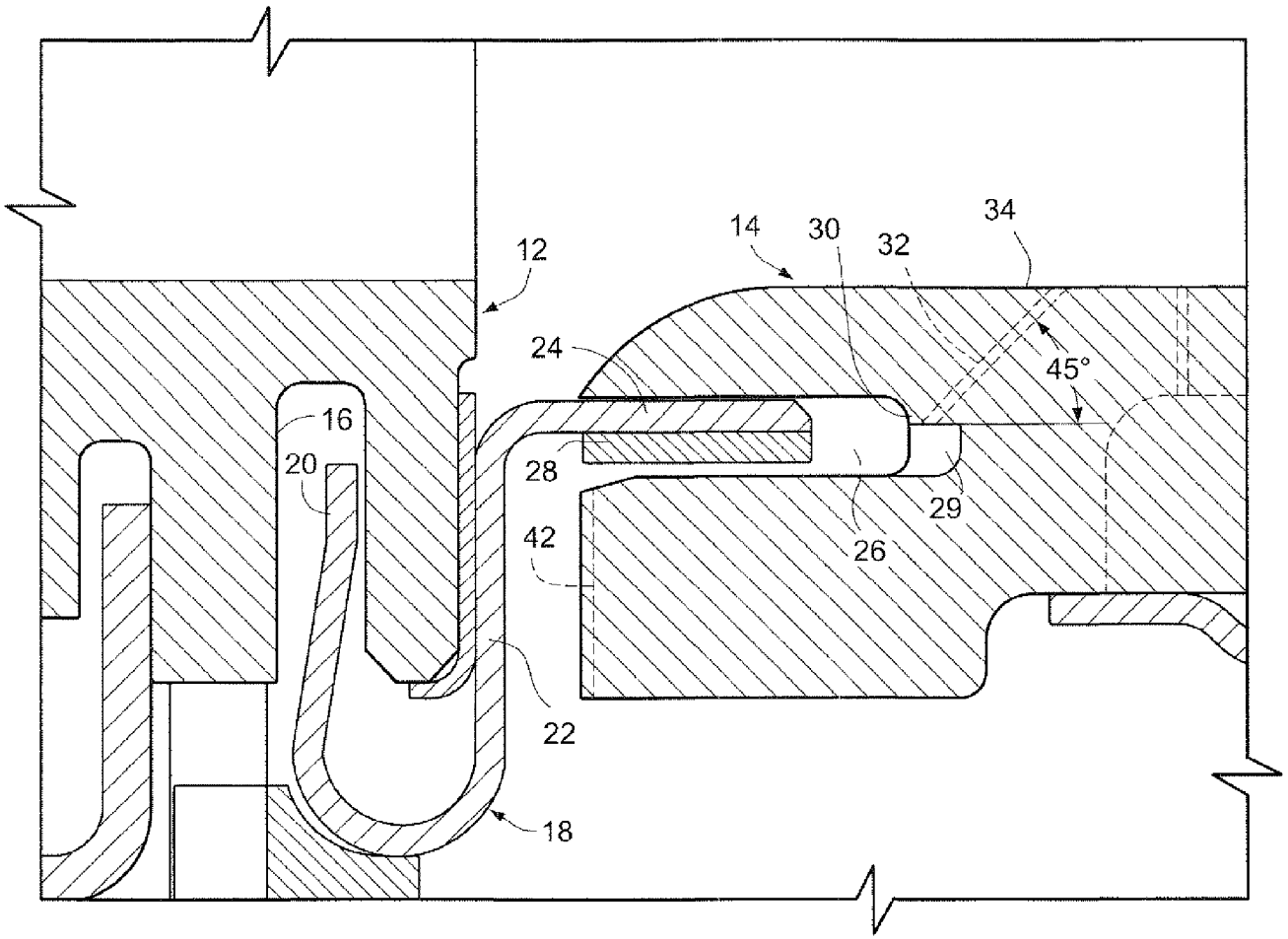
FIG. 1 is a partial side cross-section showing the interface between a gas turbine transition piece and the first-stage nozzle component, incorporating a film cooling arrangement in accordance with an exemplary but non-limiting embodiment of the invention.

With reference initially to FIG. 1, the interface 10 between a gas turbine transition piece 12 and a first stage nozzle 14 is illustrated in cross-section. The transition piece 12 is formed with at least one annular slot 16 that is adapted to receive a forward, substantially vertical leg 20 of a conventional metal seal 18. A second leg 22 of the seal 18 extends about the transition piece and an aft, substantially horizontal leg or flange 24 is adapted to be received in an annular seal slot 26. An annular shim 28 may be used to provide a closer fit for the leg 24 of the seal within the seal slot 26. This arrangement of the seal 18 interposed between the transition piece and first stage nozzle is conventional and needs no further description.

Figure 2:
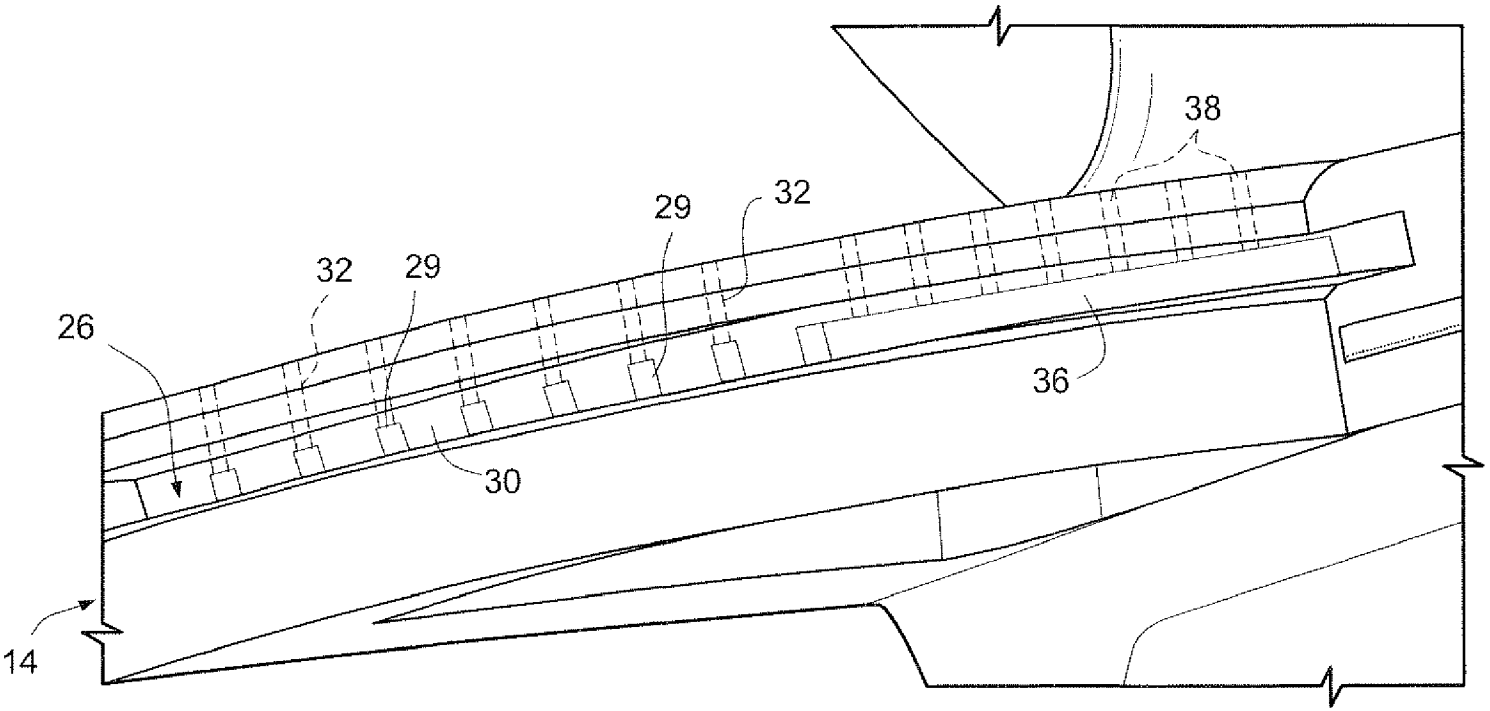
FIG. 2 is a partial front perspective view of the first-stage nozzle component shown in FIG. 1.

In accordance with a nonlimiting implementation of the invention, an aft or rearward wall of the seal slot 26 is formed to provide one or more cooling cavities 29 as best seen in FIG. 2. In one exemplary embodiment, a plurality of discrete cooling cavities 29 may be formed in the back wall 30 of seal slot 26, each cooling cavity feeding a single film cooling hole 32 that extends between an exterior surface 34 of the nozzle 14 and the respective cavity 29 (FIG. 1). The cooling hole or passages 32 extend at an angle in a range of about 25-30 degrees in the direction of gaspath flow and relative to the turbine rotor axis. The range is believed to provide optimum cooling effectiveness. It will be appreciated, however, that steeper angles (even up to 90 degrees) may be employed to cool other locations at higher temperatures. Note also that the individual cavities may have a height less than the height of the seal slot. This feature, in combination with the wall portions or partitions between the cavities, i.e., the remaining portions of back wall 30, preclude any possibility that the seal leg 24, with or without shim 28, might move into the cavities 29.

In a second exemplary but non-limiting embodiment, (shown in FIG. 2) the rear wall 30 of the seal slot 26 may be machined or otherwise formed to include a substantially continuous, annular cavity or groove 36 of a height less than the height of the back wall 30 of the seal slot 26, with a plurality of film cooling holes 38 communicating with the single annular cavity 36. In this embodiment, by limiting the height of the film cooling cavities to less than the height of the seal slot, the aft end of the seal is again precluded from entering into the cavity. It will be appreciated that other cavity arrangements are within the scope of this invention. For example, cavity 36 could be segmented, i.e., divided, into two or more arcuate segments.

As shown in FIG. 1, the relative positioning of the transition piece 12 and the seal 18 relative to the first stage nozzle 14 is shown under steady state conditions. Here, there is a clear flow path for compressor discharge cooling air to flow into the seal slot 26 and into the film cooling cavities 29 (or 36). It will be appreciated that in transient conditions such as start-up and shut-down, however, there may be relative movement among the components such that the seal leg 24 of the seal 18 moves toward and may actually engage the aft or back wall 30 of the seal slot 26.

If film cooling during such transient conditions is not regarded as critical, it would be of little or no consequence if the leg 22 of the seal 18 partially or completely blocks the flow of cooling air into the film cooling cavities 29. On the other hand, if cooling is viewed as critical even under transient conditions, one or more radial (or other) grooves 42 may be formed in the forward edge or face of the first stage nozzle 14 to insure cooling air to flow into the seal slot 26 and into the cooling cavities 29 (or 36), noting that there is some clearance between the seal leg 24 itself and the seal slot 26.

The above-described arrangements provide easy access for drilling the cooling holes or passages and allow the designer to locate those cooling holes or passages at locations where existing cavities otherwise do not provide access. In addition, by angling the cooling passages 32 as shown, the path itself has a greater length, thereby enhancing conduction cooling within the nozzle, while at the same time, enhancing cooling air film formation along the surface of the nozzle. Thus, the arrangements provide a way to apply more efficient film cooling air so as to reduce flow requirements and leakages, while increasing component life and improving engine performance.

It will also be appreciated that the cooling configurations described above are also readily employed in any stationary seal slots within the hot gas flow path of the turbine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cooling arrangement for a turbine component having a seal slot along an edge thereof, the slot having a closed end formed with at least one cooling cavity, and at least one cooling passageway extending between the cavity and an external surface of said turbine component.

2. The cooling arrangement of claim 1 wherein said at least one cooling passageway extends at an angle of between 25° and 90° relative to a direction of flow and to a rotor axis of the turbine.

3. The cooling arrangement of claim 2 wherein said angle lies in a range of from 25° to 30°.

4. The cooling arrangement of claim 1 wherein said at least one cooling cavity comprises plural discrete cavities.

5. The cooling arrangement of claim 1 wherein said turbine component comprises a first stage nozzle, and said seal slot opens in a direction facing a combustor transition piece and adapted to receive a flange portion of a seal extending between the first stage nozzle and the transition piece.

6. The cooling arrangement of claim 5 wherein said seal slot extends about a generally rectangular opening in said edge of said first stage nozzle, and wherein said at lease one cooling cavity comprises a plurality of cavities spaced from each other about said seal slot.

7. The cooling arrangement of claim 6 wherein some or all of said plurality of cooling cavities are provided with one of said cooling passageways.

8. The cooling arrangement of claim 5 wherein said seal slot extends about a generally rectangular opening in said edge of said first stage nozzle, and wherein said at least one cooling cavity comprises a single, continuous annular groove formed in said closed end of said slot.

9. A cooling arrangement for a first component of a turbine having a seal slot formed in a forward face of said first component, the seal slot extending about a generally rectangular opening in said forward face and opening in a direction toward a second turbine component and adapted to receive a flange portion of a seal extending between the first component and the second component; the slot having a closed aft end formed with at least one cooling cavity provided with at least one cooling passage extending between the cavity and an external surface of the first component, and wherein said at least one cooling passage extends at an acute angle relative to a rotor axis of the turbine.

10. The cooling arrangement of claim 9 wherein said at least one cooling passage is angled in a direction away from the second component.

11. The cooling arrangement of claim 9 wherein said acute angle is between about 25° and 30°.

12. The cooling arrangement of claim 9 wherein said at least one cooling cavity comprises plural cavities, each cavity provided with one of said cooling passages.

13. The cooling arrangement of claim 9 wherein said at least one cooling cavity comprises a single, continuous annular groove formed about said opening.

14. The cooling arrangement of claim 9 and further comprising one or more grooves formed in said forward face of said first component for insuring flow of cooling air into said slot.

15. A method of film cooling a turbine component formed with at least one seal slot adapted to receive a seal element, the method comprising:

(a) forming one or more cavities at a closed end of the seal slot;

(b) forming one or more cooling passages in each of said one or more cavities, said one or more cooling passages extending between said one or more cavities and a surface of said turbine component to be cooled.

16. The method of claim 15 wherein said plurality of passages each extend at an angle of between 25° and 90° relative to a rotor axis of the turbine.

17. The method of claim 16 wherein said angle lies in a range of from 25°-30°.

18. The method of claim 15 wherein said seal slot extends about a forward end of a first stage nozzle, and wherein said seal element is configured to extend between said seal slot and an adjacent combustor transition piece.

19. The method of claim 15 wherein said one or more cavities comprises a plurality of discrete, circumferentially spaced cavities.

20. The method of claim 15 wherein said one or more cavities comprises a single, continuous annular cavity having a height less than a height of said closed end of said seal slot.

* * * * *